United States Patent [19]

Duncan

[11] Patent Number: 4,524,667

[45] Date of Patent: Jun. 25, 1985

[54] ELECTROMAGNETIC PICKUP FOR A STRINGED MUSICAL INSTRUMENT HAVING FERROMAGNETIC STRINGS AND METHOD

[76] Inventor: Seymour Duncan, P.O. Box 4746, Santa Barbara, Calif. 93103

[21] Appl. No.: 523,067

[22] Filed: Aug. 15, 1983

[51] Int. Cl.[3] ..... G10H 3/00

[52] U.S. Cl. ..... 84/1.15; 84/1.16

[58] Field of Search ..... 84/1.16, 1.14, 1.15

[56] References Cited

U.S. PATENT DOCUMENTS

| | | | |
|---|---|---|---|
| 3,657,461 | 4/1972 | Freeman | 84/1.16 |
| 3,915,048 | 10/1975 | Stich | 84/1.15 |
| 4,442,749 | 4/1984 | DiMarzio et al. | 84/1.15 |
| 4,463,648 | 8/1984 | Fender | 84/1.16 |

*Primary Examiner*—Forester W. Isen

*Attorney, Agent, or Firm*—Daniel J. Meaney, Jr.

[57] ABSTRACT

An electromagnetic pickup adapted for use with a multistringed musical instrument having strings formed of a ferromagnetic material having a first wire coil wound in a first direction in an elongated oval shape wherein the first coil has a geometrical distance along its elongated axis which exceeds the distance between the outermost strings wherein the first coil includes an opening which extends through the interior thereof, a second wire coil wound in a second direction and in an elongated oval shape, the geometrical dimensions of which are substantially equal to that of the first coil and wherein the second coil includes a second opening which extends to the interior thereof, and wherein the second coil is positioned in a spaced opposed aligned relationship with the first coil with the first opening in axial alignment with the second opening forming a coil stack assembly having a hollowed-out central cavity, a permanent magnet assembly which is positioned in the hollowed-out central cavity with one pole positioned in a magnetic coupling relationship with the strings of the multistringed instrument and with the other pole positioned so as to be remote from the string and a circuit for electrically connecting the first coil and the second coil in either a selected dual- or single-coil configuration wherein the coil stack assembly applies a magnetic field across the strings which is intercepted by the vibrating strings to produce an electrical signal is shown. A method for utilizing an electromagnetic pickup is shown.

13 Claims, 18 Drawing Figures

ELECTROMAGNETIC PICKUP FOR A STRINGED MUSICAL INSTRUMENT HAVING FERROMAGNETIC STRINGS AND METHOD

BACKGROUND OF THE INVENTION

1. Field of the Invention

This invention relates to electrical pickups adapted for use with multistringed metal musical instruments and, more particularly, relates to an electromagnetic pickup adapted for use with a multistringed musical instrument having strings formed of a ferromagnetic material to produce an output signal, the amplitude of frequency of which is representative of the vibrations of a ferromagnetic string. In the preferred embodiment, a electromagnetic pickup is adapted for use with a guitar.

2. Description of the Prior Art

The use of electrical pickups for stringed musical instruments having ferromagnetic strings is well known in the art. One electromagnetic pickup for stringed musical instruments is described in U.S. Pat. No. 4,220,069 and comprises a pickup assembly utilizing a single bar magnet, a coil means and at least one metallic, unmagnetized pole piece operationally associated with the strings of an instrument. Other single-cell magnetic pickup devices for stringed musical instruments are disclosed in U.S. Pat. Nos. 4,026,178; 4,050,341; 4,133,243; and 4,320,681.

The use of an electromagnetic pickup having a plurality of coils which are positioned in a side-by-side relationship and having permanent magnet members is discussed in U.S. Pat. Nos. 4,283,982; 3,983,777; 3,983,778; and 3,962,946.

An electromagnetic pickup having a coil formed by first and second windings wound in parallel on the same coil bobbin, one on top of the other, is disclosed in U.S. Pat. No. 3,711,619.

An electromagnetic pickup having two coils, each of which have openings in the center thereof and wherein the aligned coils are divided and spaced apart by a magnetic pole piece and wherein the aligned openings have a permanent magnet member located therein wherein one edge of the permanent magnet member is adapted to be positioned adjacent strings formed of ferromagnetic materials on a multistringed instrument, is disclosed in U.S. Pat. No. 3,902,394.

An electromagnetic pickup having coils arranged in a similar manner to the coils of U.S. Pat. No. 3,902,394 but wherein two separate rectangular-shaped permanent magnet members are positioned one on each side of and coniguous the magnetic pole piece and with a ferromagnetic material in the form of a plurality of screws located in the openings of the coil and threaded into and through the magnetic pole piece is disclosed in U.S. Pat. No. 3,916,751.

A single pickup frequency control for a stringed instrument wherein the pickup comprises a bar magnet, the poles of which are situated at the top and the bottom faces thereof and wherein a divider surrounds the magnet transversely of and parallel with the two polar faces of the magnet and wherein the wire coils surround the magnet on each side of the divider plate with the coils so connected that the electrical path of one coil is clockwise while the electrical path of the other coil is counterclockwise is disclosed in U.S. Pat. No. 3,657,461.

Electrical pickups manufactured and sold by Gibson Guitar Company in the early 1960s had an upper coil and a lower coil divided by a horizontal permanent magnet with the vertically extending openings in the coil completely filled with an iron load wherein one of the coils having the iron load was positioned in a spaced relationship from ferromagnetic strings on a multistringed instrument.

SUMMARY OF THE PRESENT INVENTION

The invention relates to a new, novel and unique electrical pickup for a stringed musical instrument having ferromagnetic strings. In the preferred embodiment, the electrical pickup includes a pair of axially spaced, elongated coils arranged to have the elongated axis extend substantially normal to the width of the strings on an instrument and which define an elongated passageway therethrough such that the opening in each coil communicates with each other. The electrical pickup further includes an elongated permanent magnet having a length which is less than that of the elongated passageway and wherein the elongated permanent magnet is disposed intermediate the coils. The elongated permanent magnet has a width which is less than the width of the elongated passageway in each coil defining an elongated cavity between the elongated permanent magnet and the exterior of each coil. A pair of magnetic pole pieces are disposed in each elongated cavity having an end piece adjacent the permanent magnet and enclosed by a portion of the coil and wherein the other opposite end face of one of the pair of magnetic pole pieces is adapted to be positioned in a spaced relationship to the ferromagnetic strings to define a magnetic reluctance path between each of the ferromagnetic strings to the permanent magnet wherein the reluctance path includes the predetermined air gap, the magnetic pole piece having a preselected permeability and a portion of the permanent magnet member.

The present invention overcomes several of the known disadvantages of the prior art electrical pickups. The electromagnetic pickups having a double coil and central permanent magnet members have the coils thereof permanently wired such that coils cannot easily be electrically connected into one of a plurality of different connections such as (1) series-connected, out-of-phase, humbucking; (2) parallel-connected, out-of-phase, humbucking; (3) split-coil/single-coil; and (4) series-connected, in-phase, nonhumbucking.

The use of a double-coil pickup, whether the coils are arranged in a side-by-side relationship or in an upper and lower relationship, provides greater flexibility in controlling the qualities of the sound produced by the multistringed instrument having strings formed of a ferromagnetic material. The known prior art devices are constructed such that an iron load or a unmagnetized ferromagnetic material is located within and fills the entire upper and lower openings of each coil. Further, the coils are divided by either a permanent magnet member or by a magnetic pole piece having permanent magnets affixed thereto. The magnetic reluctance of the coil arrangement and the characteristics of the magnetic flux path are controlled solely by the magnetic pole pieces which are unmagnetized. Thus, the permeability of the "iron load," or the magnetic pole pieces, greatly affects the sound and quality of the electrical signal produced as an output signal in response to vibration of the strings. The quality of the sound, the smoothness of the sound and the ability of the electromagnetic pickup to retain the sound is severly limited.

In the present invention, the electromagnetic pickup assembly can include a coil form assembly in combination with a permanent magnet member, which results in an improved assembly having separate elements rather than an assembly having one or more monolythic magnet members having wire wound therearound for the coil in the manner as that disclosed in U.S. Pat. No. 3,657,461.

One advantage of the present invention is that the magnetic reluctance of the path extending from the coils to the ferromagnetic strings comprises a permanent magnet member, a magnetic pole piece and an air gap.

Another advantage of the present invention is that, by selectively varying the geometrical dimensions of the permanent magnet material, the pole piece and the air gap, a wide range of output sounds can be obtained.

A still further advantage of the present invention is that the quality of the amplified vibrations are sharp and clear, with the absence of a 60-cycle hum, and the electromagnetic pickup's ability to retain or hold a signal can be controlled by selectively varying the characterisitcs of the permanent magnet means located in the center of the stacked, undivided coils.

A still further advantage of the present invention is that the permanent magnet member can be formed of a elongated permanent magnet member having upper and lower pole pieces wherein one of the magnetic pole pieces is positioned adjacent the ferromagnetic strings of a multistringed instrument.

A still further advantage of the present invention is that the entire coil stack assembly can be encapsulated in a housing and a flatwork so as to be fully enclosed.

A still further advantage of the present invention is that the coil stack assembly can have one of the pole pieces exposed so as to be positioned adjacent the ferromagnetic strings of a multistringed instrument wherein the entire assembly can be potted in a standard potting compound.

A still further advantage of the present invention is that the permanent magnet members may be in the form of a plurality of elongated, cylindrically shaped permanent magnet members which extend vertically within the center of the coil and are positioned such that one end of each of the cylindrically shaped permanent magnet members is located adjacent the ferromagnetic strings of a multistringed instrument.

A still further advantage of the present invention is that the output signal characterisitcs of the electromagnetic pickup and the amplified sounds produced therefrom can be varied over a wide range of response, smoothness and retention qualities by controlling the length and position of the cylindrically shaped permanent magnet members relative to the ferromagnetic strings.

A still further advantage of the present invention is that the elongated, cylindrically shaped permanent magnet members can be assembled in groups of twos and positioned relative to the large diameter ferromagnetic strings normally used in a jazz bass-type stringed instrument such that the strings interact with the magnet members over a larger area of excursion.

A still further advantage of the present invention is that the pole piece can be exposed and positioned directly under the ferromagnetic strings to produce a very fast response and clear sharp signal which is characteristic of a fast response, or hot-type pickup.

A still further advantage of the present invention is that a method for producing an output signal is shown utilizing an electromagnetic pickup wherein the reluctance path characteristic is determined by a permanent magnet member located partially in the opening in the coil, a magnetic pole piece located partially in the coil and an air gap located between the top of the coil stack assembly and the springs.

A still further advantage of the present invention is that the electromagnetic pickup assembly has a coil form assembly which enables the coils to be wound separately and used in a double coil assembly with one or both permanent magnet members and iron loading members.

BRIEF DESCRIPTION OF THE DRAWING

The foregoing and other advantages and features of this invention will become apparent from the following description of the preferred embodiment, when considered together with the illustrations and the accompanying drawings, which include the following figures.

DESCRIPTION OF THE PREFERRED EMBODIMENT

Figure 1:
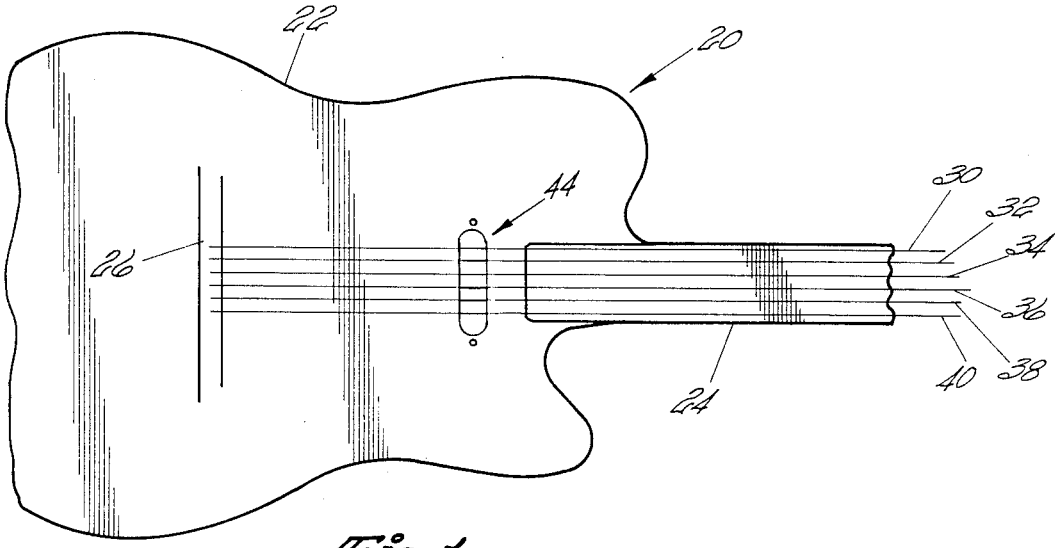
FIG. 1 is a pictorial representation of a multistringed musical instrument in the form of a guitar having an electromagnetic pickup, using the teachings of this invention, positioned at a predetermined spaced relationship from the ferromagnetic strings of the instrument.

FIG. 1 illustrates a guitar shown generally by arrow 20 comprising a body 22, neck 24, bridge assembly 26, a plurality of strings 30, 32, 34, 36, 38, 40, and an electromagnetic pickup shown by arrow 44. The strings 30, 32, 34, 36, 38 and 40 are formed of a ferromagnetic material. Typically, the strings 30–40, inclusive, are graduated in diameter, as is known in the art. The ferromagnetic strings are capable of being magnetized by the electromagnetic pickup 44, as will be described hereinafter. Although the disclosure set forth herein relates to a six steel-stringed guitar, any multistringed instrument having strings formed of a ferromagnetic material may utilize the electromagnetic pickup described herein.

Figure 2:
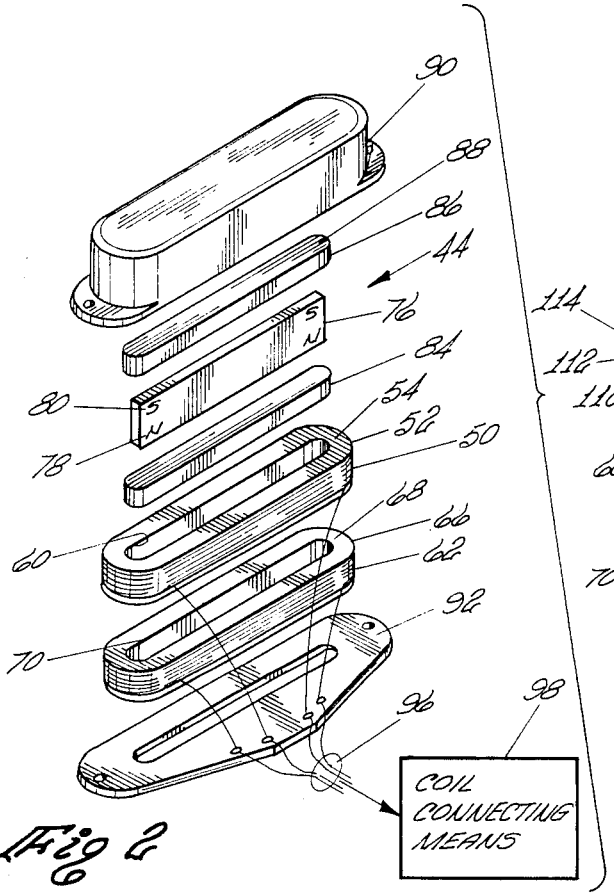
FIG. 2 is an exploded view of one embodiment of electromagnetic pickup using the teachings of the present invention.
Figure 5:
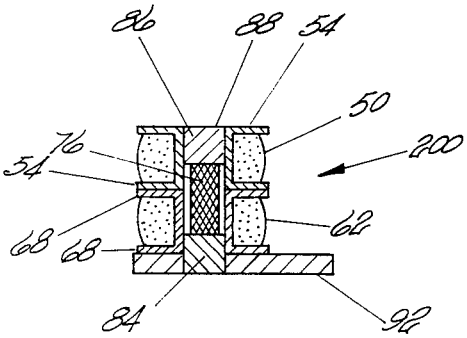
FIG. 5 is a sectional view of a coil stack assembly of the embodiment of FIG. 2.
Figure 8:
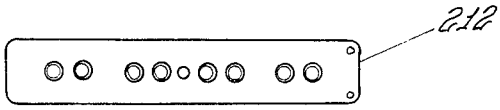
FIG. 8 is a top plan view of the bobbin of FIG. 6.
Figure 6:
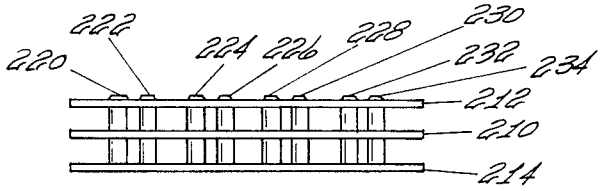
FIG. 6 is a front plan view of a bobbin of another embodiment of an electromagnetic pickup using the teachings of the present invention.
Figure 7:
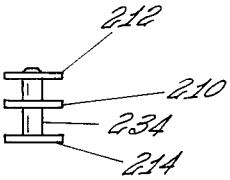
FIG. 7 is a right end plan view of the bobbin of FIG. 6.
Figure 9:
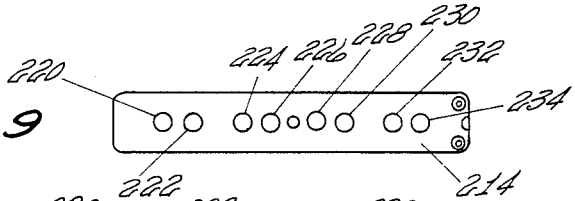
FIG. 9 is a bottom plan view of the bobbin of FIG. 6.
Figure 10:
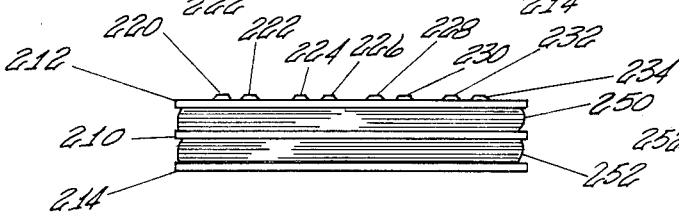
FIG. 10 is a front plan view of the bobbin of the embodiment of FIG. 6 having a upper and lower coil wound therearound.
Figure 11:
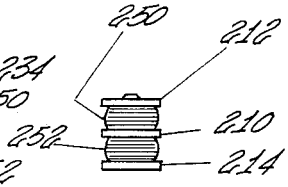
FIG. 11 is a right end plan view of the electromagnetic pickup of FIG. 10.

Referring to FIG. 2, one embodiment of the electromagnetic pickup shown by arrow 44 is illustrated in the exploded view. After assembly, the electromagnetic pickup 44 is an integral unit, as illustrated in FIG. 5.

In the embodiment of FIG. 2, the electromagnetic pickup 44 has a first coil 50 which is one of a pair of axially spaced elongated coils having wire wound in a first direction and in an elongated oval shape having a major axis and a minor axis. The first coil 50 has a first geometrical dimension along the major axis which exceeds the distance between the outermost strings 30 and 40, as illustrated in FIG. 1. Thus, the elongated axis of the coil extends substantially normal to the width of the strings 30 to 40, inclusive, of FIG. 1. The first coil 50 has a second geometrical distance along the minor axis, which is substantially less than the distance along the major axis. The first coil 50 is wound on a coil form or bobbin 52. The bobbin 52 includes means defining an upper and lower edge 54 and first passageway or a first opening 60 which extends through the center thereof.

A second coil 62 is located in spaced alignment with the first coil 50. The second coil 50, in this embodiment, has wire wound in the same direction as the first direction in which the wire is wound in the first coil 50. The second coil 62 has a major and minor axis, and geometrical dimensions thereof are substantially equal to that of the first coil 50. If desired, one of the two coils can be wound in the opposite direction. The second coil 62 is also wound on a coil form or bobbin 66 which includes means defining an upper and lower edge 68 and a second passageway or second spring 70 which extends through the center thereof. The first opening 60 and the second opening 70 define a hollowed-out central cavity defined by the openings 60 and 70 communicating with each other. The coils 50 and 62 form a coil stack assembly 200 therebetween, as shown in FIG. 5. A permanent magnet means, which includes an elongated permanent magnet 76 having a north pole 78 and a south pole 80, is positioned in the hollowed-out central cavity defined by openings 60 and 70.

The elongated permanent magnet 76 has a width which is less than the total width of the coil assembly, for example, a width approximately equal to about 50% of the depth of the hollowed-out central area in the coil assembly formed of the coils 50 and 62.

When the elongated permanent magnet 76 is located in the center of the hollowed-out central area, an elongated cavity is formed within the hollowed-out central area between the edge of the elongated permanent magnet 76 and each of the coil ends exterior to the coil assembly 200, FIG. 5.

A pair of blades or magnetic pole pieces 84 and 86 are disposed within each of the elongated cavities defined by the elongated permanent magnet 76 and the exterior of each coil 50 and 62. One end of each of the magnetic pol pieces 84 and 86 may be located adjacent or contiguous the elongated permanent magnet 76. One of the other ends of one of the magnetic pole pieces, for example, end 88 of magnetic pole piece 86, is adapted to be located adjacent the strings of a music instrument, as illustrated in FIG. 1. A plastic housing, or cover, 90 cooperates with a flatwork or plate 92 to encapsulate the electromagnetic pickup.

In the embodiment illustrated in FIG. 2, the magnetic pole piece 86 and the air gap in the space defined by the predetermined distance between the strings 30–40, inclusive and the magnetic pole piece 86 define a magnetic reluctance path between each of the ferromagnetic strings 30–40, inclusive, and the elongated permanent magnet 76. The reluctance characteristics of the magnetic reluctance path can be controlled by selecting the permeability of the magnet material and the strength of the elongated permanent magnet 76 to give the desired output sound characteristic.

The coil stack assembly 200 (FIGS. 2, 3 and 4) requires a four-conductor cable illustrated schematically by the four-conductor cable 96. The four-conductor cable 96 is operatively coupled to a coil connecting means 98.

In operation, the coil connecting means 98 is operatively coupled to the first coil 50 and the second coil 62. The coil connecting means 98 is capable of connecting the coils 50 and 62 into at least one of a series opposition, parallel opposition or selected single coil (or split) configuration. If desired, additional components can be incorporated into the coil connecting means 98 for altering the phasing between the coils 50 and 62. The coil connecting means 98 cooperates with the coil stack assembly to sense a change in voltage of the coils in response to a change in the magnetic field, which voltages are induced in one or both of the coils 50 and 62. The lines of flux of the coil stack assembly are adapted to traverse a path from the hollowed-out central cavity of the coil stack, through the permanent magnet means to the ferromagnetic strings defining a magnetic flux path, the reluctance of which is varied in response to the vibration of the strings which is adapted to vary the lines of flux of the magnetic field causing a variation in amplitude and frequency of the voltage induced in the coil stack assembly.

Figure 3:
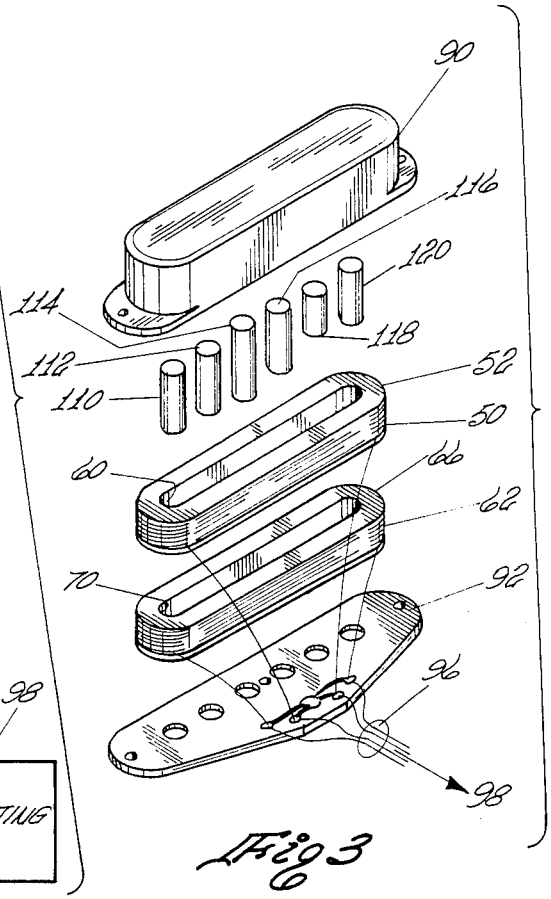
FIG. 3 is an exploded view of another embodiment of an electromagnetic pickup using the teachings of the present invention.

FIG. 3 shows another embodiment of the invention with the coils 50 and 62, the bobbins 52 and 66, the plastic housing 90, the flatwork 92, the four-conductor cable 96 and the coil connecting means 98 being identified with the same numerals. The major difference is that the permanent magnet means include a plurality of spaced cylindrically shaped permanent magnet elements 110, 112, 114, 116, 118 and 120. Each of the cylindrically shaped permanent magnet elements 110–120, inclusive, has an axial length which enables the permanent magnet element to be located within the hollowed-out central cavity and a diameter which is less than the second geometrical dimension of the minor axis of the first opening 60 and the second opening 70. The cylindrically shaped permanent magnet elements 110–120, inclusive, are located in the hollowed-out central area with the axis thereof in spaced parallel relationship to each other and wherein the distance between the axis of each cylindrically shaped permanent magnet elements is adapted to be substantially equal to the space between two of the strings. One end of each of the cylindrically shaped magnet elements is adapted to be located at a selected distance from a string to form an air gap therebetween.

In the preferred embodiment of FIGS. 2 and 3, the permanent magnet material may be formed of ALNICO or a ceramic magnetic material. ALNICO V magnet material is preferred. A coil winding resistance in the order of 20,000 ohms is preferred. In the embodiment of FIG. 3, the following lengths for each string of ALNICO V, cylindrically shaped magnets having a diameter of 0.187 inch are preferred:

| String Note | C | A | D | C | B | E. |
|---|---|---|---|---|---|---|
| Length (inches) | 0.720 | 0.720 | 0.737 | 0.737 | 0.656 | 0.688 |

As noted above, at least two of the cylindrically shaped magnetic elements have different axial lengths. This is referred to as the "staggered coil" effect which produces a "vintage STRAT sound," wich is a pleasant sound having a smoother response. Also, tonal characteristics of this pickup device can be varied by changing the gauge of the coil wire.

Figure 4:
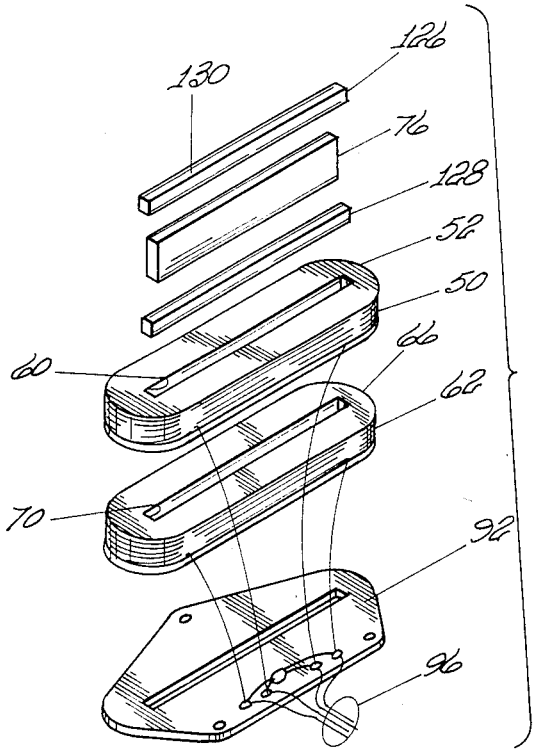
FIG. 4 is an exploded view showing yet another embodiment of an electromagnetic pickup utilizing the teachings of the present invention.

FIG. 4 illustrates another embodiment of the electromagnetic pickup wherein the design of the magnetic pole pieces 126 and 128 is rectangular-shaped and wherein one of the magnetic pole pieces, e.g., pole piece 126, is exposed. The remaining elements are the same as in FIG. 3. The entire coil assembly is potted in a standard potting compound having edge 130 of rectangular magnetic pole 126 exposed.

FIG. 5 illustrates a coil stack assembly 200, which is the embodiment of FIG. 3, in an assembled configuration as an integral unit.

FIGS. 7–11, inclusive, illustrate another embodiment of the present invention. The coil form includes a center section 210, a top section 212 and a bottom section 214 which define top and bottom bobbins. The cylindrically shaped permanent magnet members, all having the same axial length, are shown as 220–234, inclusive, are arranged in pairs. A first coil 250 is wound around the top bobbin, and a second coil 258 is wound around the bottom bobbin. The pairing of the magnetic elements in pairs comprising 220–222, 224–226, 228–230 and 232–234 produce a sound associated with a jazz bass guitar. The larger strings, when plucked, travel over a wide area, and the double elements provide a wide area with magnetic flux which is intercepted by the strings.

The waveforms of FIGS. 12, 13, 14 and 15 are examples of pickup outputs plotted as a function of frequency for a number of different embodiments.

Figure 12:
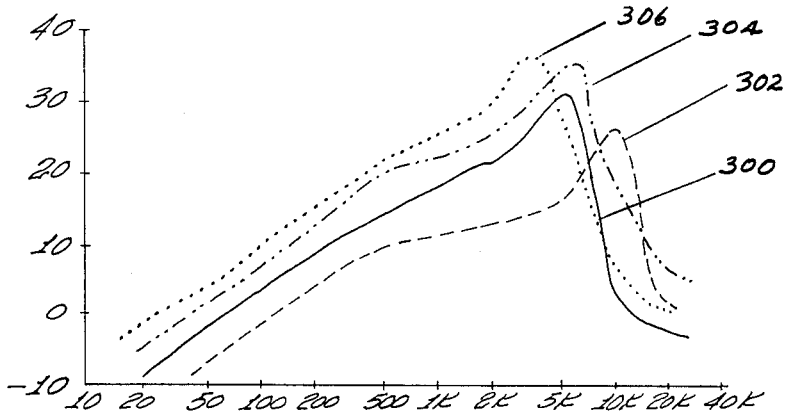
FIGS. 12, 13, 14 and 15 are waveforms of the decibel level of the output signal plotted as a function of frequency for a number of variations of the embodiments of the electromagnetic pickups disclosed herein.

FIG. 12 is a graph illustrating the four electrical connections options available for the electromagnetic pickup apparatus of the present invention. Curve 300 illustrates the electrical characteristics of the electromagnetic pickup apparatus having the coils connected in a series, out-of-phase, humbucking mode arrangement. The 60 Hertz hum can be canceled out in the humbucking mode arrangement.

Curve 302 illustrates the electrical characteristics of the electromagnetic pickup apparatus having the coils connected in a parallel, out-of-phase, humbucking mode arrangement.

Curve 304 illustrates the electrical characteristics of the electromagnetic pickup apparatus in a split-coil/single-coil arrangement.

Curve 306 illustrates the electrical characteristics of the electromagnetic pickup apparatus in a series, in-phase, non-humbucking arrangement.

Figure 17:
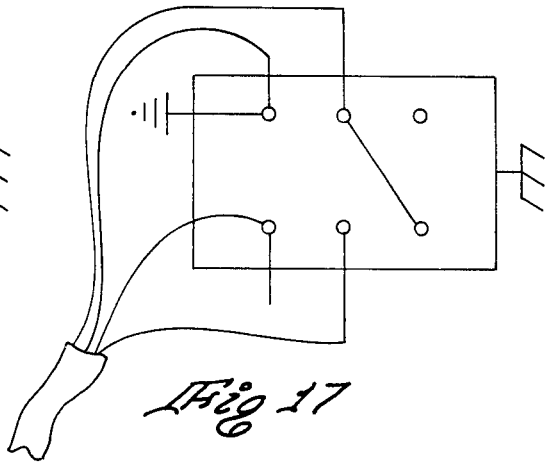
FIG. 17 is a wiring diagram of a coil connecting means adapted for use with the electromagnetic pickups disclosed herein.

The four-wire conductor cable permits these electrical connections and the embodiment illustrated by the curves 300–306 can be obtained by use of the wiring diagram of FIG. 17 with the coils appropriately connected.

Figure 13:
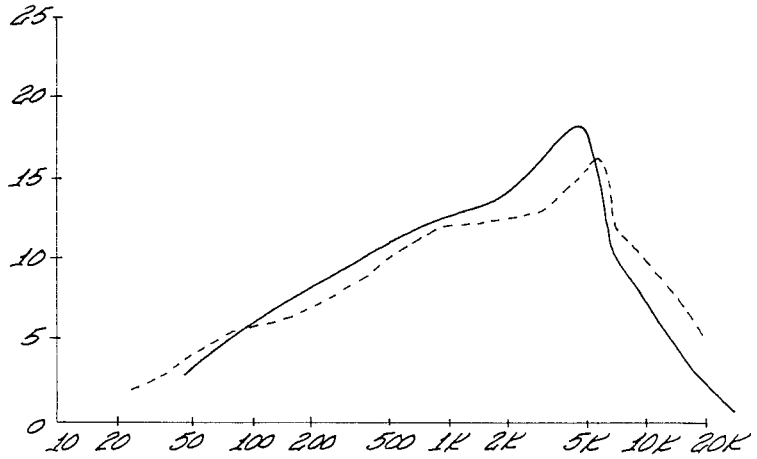
Figure 14:
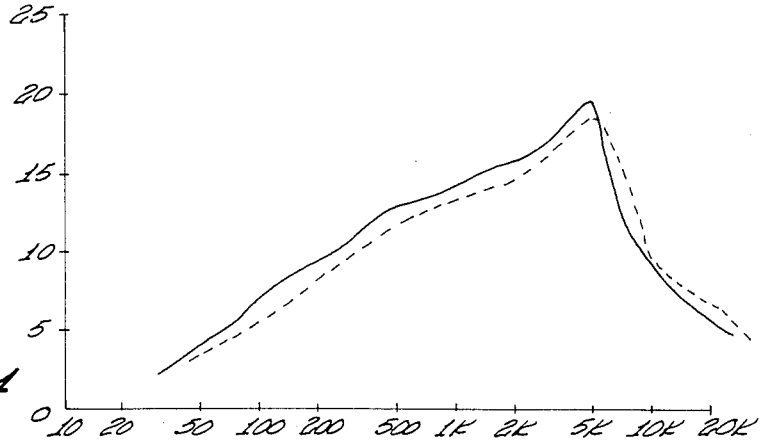

The waveforms of FIGS. 13 and 14 show various operating characteristics at higher frequencies for variations in the electrical characteristics of the embodiment illustrated in FIGS. 2 and 4.

Figure 15:
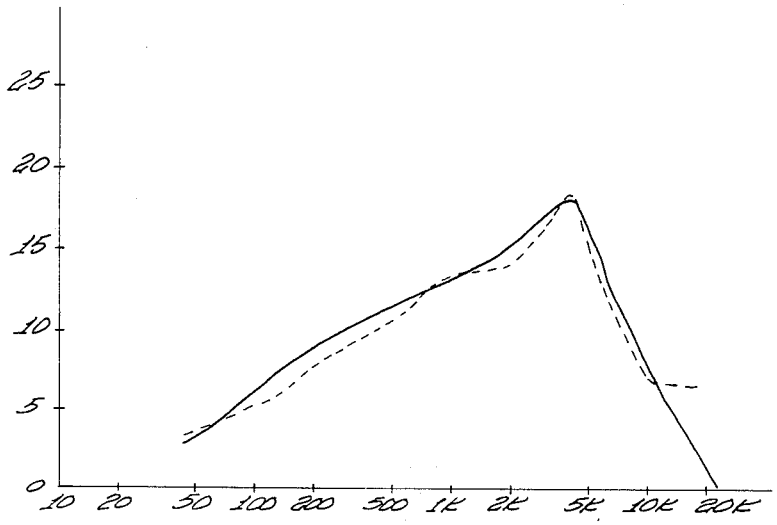

The waveforms of FIG. 15 show various operating characteristics at higher frequencies for variations in the electrical characteristics of the embodiment illustrated in FIGS. 6–11, inclusive.

Figure 16:
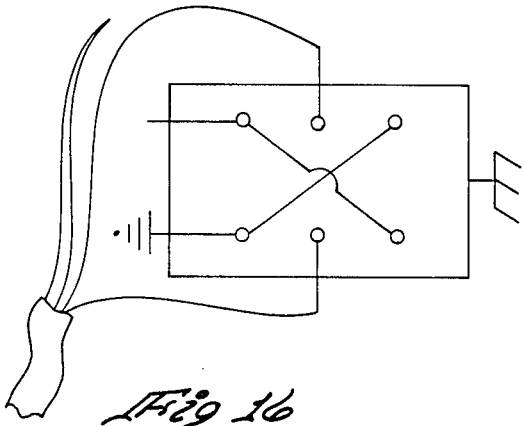
FIG. 16 is a wiring diagram of the embodiment of the electromagnetic pickup of FIGS. 7–11, inclusive.
Figure 18:
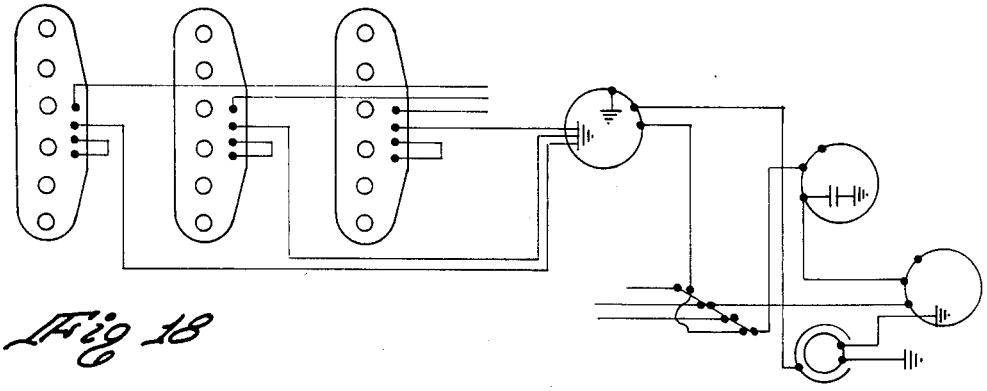
FIG. 18 is a wiring diagram for three electromagnetic pickups utilized on a single, multristringed instrument having ferromagnetic strings.

FIGS. 16, 17 and 18 are illustrations of the various circuit configurations for the coil connecting means 98 of FIG. 2. Specifically, FIG. 16 is a wiring diagram for an electrical pickup of the embodiment illustrated in FIGS. 2–4 and 6–11, inclusive, wherein two of the four conductors are connected for phasing when used with another pickup.

The wiring diagram of FIG. 17 can be used with the electromagnetic pickup in FIGS. 2–11, inclusive, and can be used to connect the coils in a series/parallel relationship or a series/split/parallel relationship.

The wiring diagram of FIG. 18 can be used for connecting three electromagnetic pickups of the type illustrated in FIG. 2 or 3 for standard noise cancelling operation.

What is claimed is:

1. An electromagntic pickup adapted for use with a multistringed musical instrument having strings formed of a ferromagnetic material comprising a first coil having wire wound in a first direction and in an elongated oval shape having a major and minor axis, said first coil having a first geometrical distance along the major axis which exceeds the distance between the outermost strings of a multistringed musical instrument adapted to use the electromagnetic pickup and a second geometrical distance along the minor axis which is substantially less than that along the major axis, said first coil including means defining a first opening which extends through the interior thereof;

a second coil having wire wound in a second direction and in an elongated oval shape having major and minor axes and the geometrical dimensions of which are substantially equal to that of said first coil, said second coil including means defining a second opening which extends through the interior thereof, said second coil being positioned in a spaced opposed aligned relationship with said first coil with the first opening of said first coil in axial alignment with the second opening of said second coil positioning the major axis of said first coil in a spaced parallel aligned relationship with the major axis of said second coil forming a coil stack assembly having a hollowed-out central cavity defined by said first opening communicating with said second opening;

a permanent magnet means having a north magnetic pole and a south magnetic pole positioned in said hollowed-out central cavity with one of said north magnetic pole and south magnetic pole positioned therein so as to be adapted to be adjacent to and to magnetically couple with a string of a said multistringed musical instrument and with the other of said north magnetic pole and south magnetic pole positioned therein so as to be adapted to be remote to a string of a said multistringed musical instrument;

said permanent magnetic means further including a plurality of spaced, cylindrically shaped permanent magnet elements having an axial length which enables the permanent magnet elements to be located within the hollowed-out central cavity and a diameter which is less than the second geometrical dimension of the minor axis of said first opening and said second opening and wherein at least two of the cylindrically shaped permanent magnet members have different axial lengths, said cylindrically shaped permanent magnetic elements being positioned in said hollowed-out central cavity with the axes thereof in spaced parallel relationship to each other; and coil connecting means operatively coupled to said first coil and said second coil to selectively connect the same in at least one of series opposition, parallel opposition and selected single coil configuration, said coil connecting means and coil stack assembly being adapted to produce a magnetic field which traverses a path from the hollowed-out central cavity of the coil stack assembly, through said permanent magnet means to a said string of a said multistringed musical instrument formed of ferromagnetic material defining a magnetic flux path, the reluctance of which is varied in response to the vibration of a said string of a said multistringed musical instrument which is adapted to vary the magnetic field inducing a voltage into said coils which varies in amplitude and frequency.

2. The electromagnetic pickup of claim 1 wherein the end of each cylindrically shaped permanent magnet means is adapted to be positioned adjacent a string is substantially coplanar with the other ends of each of the cylindrically shaped magnet members which are adapted to likewise be positioned adjacent to the other strings, all of which are adapted to define a gap having a selected distance and wherein the opposite ends of each of the cylindrically shaped magnet members are in a staggered relationship.

3. The electromagnetic pickup of claim 1 wherein said first coil and said second coil are wound in the same direction.

4. The electromagnetic pickup of claim 1 wherein the cylindrically shaped permanent magnet elements are assembled in pairs with a selected distance between adjacent pairs.

5. The electromagnetic pickup of claim 1 wherein each cylindrically shaped permanent magnet element has a selected axial length.

6. The electromagnetic pickup of claim 1 wherein said first coil and said second coil are wound in opposite directions.

7. An electromagnetic guitar pickup comprising a substantially planar support member;

a first coil form formed of nonmagnetic material having elongated oval shape and including means for defining a first wire receiving channel around the periphery thereof, said first coil form having a first geometrical dimension along the major axis of the elongated oval shape which exceeds the distance between the outermost strings of a said guitar adapted to use the electromagnetic pickup, said coil form including means for defining a first opening which extends through the interior thereof;

a first wire coil wound in a first direction in the first wire-receiving channel of said first coil form;

a second coil form formed of a nonmagnetic material and having an elongated oval shape and including means for defining a second wire receiving channel around the periphery thereof, said second coil form having geometrical dimension along its major and minor axes which are substantially equal to that of said first coil form, said second coil form including means for defining a second opening which extends through the interior thereof, said second coil form being positioned in an aligned, spaced opposed relationship with said first coil form with the first opening of said coil form in axial alignment with the second opening of said coil form positioning the major axis of said first coil in a spaced parallel aligned relationship with the major axis of said second coil form forming a stacking relationship with said first coil form having a hollowed-out central cavity extending therethrough defined by said first opening communicating with said second opening;

a second coil form with wire wound in a second direction in the second wire-receiving channel of said second coil form;

means for operatively selectively connecting the first wire coil of said first coil form with said second wire coil;

a permanent magnet means having a magnetic north pole and a magnetic south pole positioned in said hollowed-out central cavity with one of said magnetic north pole and said magnetic south pole being adapted to be positioned in the hollowed-out central cavity such that when the electromagnetic pickup is positioned on a guitar at least one of said magnetic north pole and said magnetic south pole are adapted to magnetically couple the strings;

said permanent magnetic means further including a plurality of spaced, cylindrically shaped permanent magnet elements having axial lengths which enable the permanent magnet elements to be located within the hollowed-out central cavity and a diameter which is less than the second geometrical dimension of the minor axis of said first opening and said second opening and wherein at least two of the cylindrical shaped permanent magnet members have different axial lengths, said cylindrically shaped permanent magnetic elements being positioned in said hollowed-out central cavity with the axes thereof in spaced parallel relationship to each other; and means operatively coupled to said first wire coil and said second wire coil for selectively connecting same in at least one of a series opposition, parallel opposition and selected single coil configuration.

8. A method for electromagnetically picking up vibrations from ferromagnetic strings on a multistringed musical instrument comprising the steps of:

positioning at a selected location and gap distance relative to strings of a multistringed musical instrument a coil stack assembly having a first coil having a wire wound in a first direction therearound in spaced, aligned relationship with a second coil having wire wound in a second direction therearound and an elongated oval shaped hollowed-out central area having a permanent magnet means located therein with at least one of a north magnetic pole and a south magnetic pole located near the strings, said permanent magnet means having a plurality of spaced, cylindrically shaped permanent magnet elements wherein at least two of the cylindrically shaped permanent magnet elements have different axial lengths;

electrically connecting with an electrical connecting means said first coil and said second coil into at least one of a series opposition, parallel opposition and selected single-coil configuration;

vibrating at least one of said ferromagnetic strings to vary the reluctance of the air gap and induce a voltage in at least one of said first coil and second coil which represents the vibrations of a second ferromagnetic string; and sensing the change in amplitude and frequency of said voltage to produce an output signal representative of the vibrations of a said string.

9. The method of claim 8 further comprising the step of amplifying the output signal.

10. An electrical pickup for a stringed musical instrument having ferromagnetic strings, said pickup comprising a pair of axially spaced, elongated coils arranged to have their elongated axis extend substantially parallel to the width of the strings on an instrument and defining an elongated passageway through each coil which communicates with each other;

a plurality of spaced, cylindrical shaped elongated permanent magnet members, at least two of which have different lengths along their longitudinal axis and disposed in said elongated passageway with each axis of each permanent magnet member extending substantially through each coil and positioned with one end of each of said elongated permanent magnets being adapted to be positioned in a predetermined spaced relationship from a selected one of said ferromagnetic strings.

11. The electrical pickup of claim 10 in which said coils are connected in a series, opposing relationship.

12. The electrical pickup of claim 10 in which the coils are respectively disposed on a pair of bobbins wherein said bobbins, coils and pole pieces are formed into an integral assembly.

13. An electrical pickup for a stringed musical instrument having ferromagnetic strings, said pickup comprising a pair of elongated spaced coils having a center cavity and wherein the coils are connected in series operation;

a pair of spaced elongated permanent magnet members, at least two of which have different lengths along their longitudinal axis and disposed in the center cavity with each axis of each permanent magnet member extending substantially through each coil and positioned with one end of each of said permanent magnets positioned in a spaced relationship from a selected one of said ferromagnetic strings.

* * * * *